US005333481A

United States Patent [19]

Späth

[11] Patent Number: 5,333,481

[45] Date of Patent: Aug. 2, 1994

[54] APPARATUS FOR SPATIAL UNCOILING AND STRETCH-BENDING PROCESS IN COMBINATION WITH A BENDING MANDREL STATION

[76] Inventor: Walter Späth, Hardstrasse 8, D-7705 Steisslingen, Fed. Rep. of Germany

[21] Appl. No.: 776,068

[22] Filed: Oct. 16, 1991

[30] Foreign Application Priority Data

Oct. 18, 1990 [DE] Fed. Rep. of Germany ..... 4033031

[51] Int. Cl.[5] ..... B21D 7/04

[52] U.S. Cl. ..... 72/150; 72/151

[58] Field of Search ..... 72/150, 151, 153, 149, 72/296, 370

[56] References Cited

U.S. PATENT DOCUMENTS

| | | | |
|---|---|---|---|
| 1,587,931 | 6/1926 | Wolders | 72/150 |
| 1,982,164 | 11/1934 | Hoener | 72/153 |
| 3,121,538 | 2/1964 | Klingensmith | 72/151 |
| 3,339,391 | 9/1967 | Kowalski | 72/153 |
| 4,009,601 | 3/1977 | Shimizu | 72/150 |
| 4,236,398 | 12/1980 | Schwarze . | |
| 4,238,945 | 12/1980 | Busse | 72/150 |
| 4,941,338 | 7/1990 | Spath | 72/155 |

FOREIGN PATENT DOCUMENTS

| | | |
|---|---|---|
| 1627531 | 6/1970 | Fed. Rep. of Germany . |
| 2746721 | 4/1979 | Fed. Rep. of Germany . |
| 3618701 | 12/1987 | Fed. Rep. of Germany . |
| 3719033 | 12/1988 | Fed. Rep. of Germany . |

*Primary Examiner*—Daniel C. Crane
*Attorney, Agent, or Firm*—Keck, Mahin & Cate

[57] ABSTRACT

Described is a spatial uncoiling and stretch-bending process in combination with a mandrel bending station and the corresponding apparatus, in which the section being bent is first clamped at either end and prestressed and the section is then bent, with at least one section roller being pressed against the section in the forming zone and three-dimensionally repositioned. To also permit the bending of closed or partially open sections, the invention provides that the mandrel bending station, with the mandrel or mandrels around which the section is bent, move in agreement with the motion of the section rollers, which are pressed from the outside onto the mandrel bending station.

6 Claims, 4 Drawing Sheets

Figure 1:
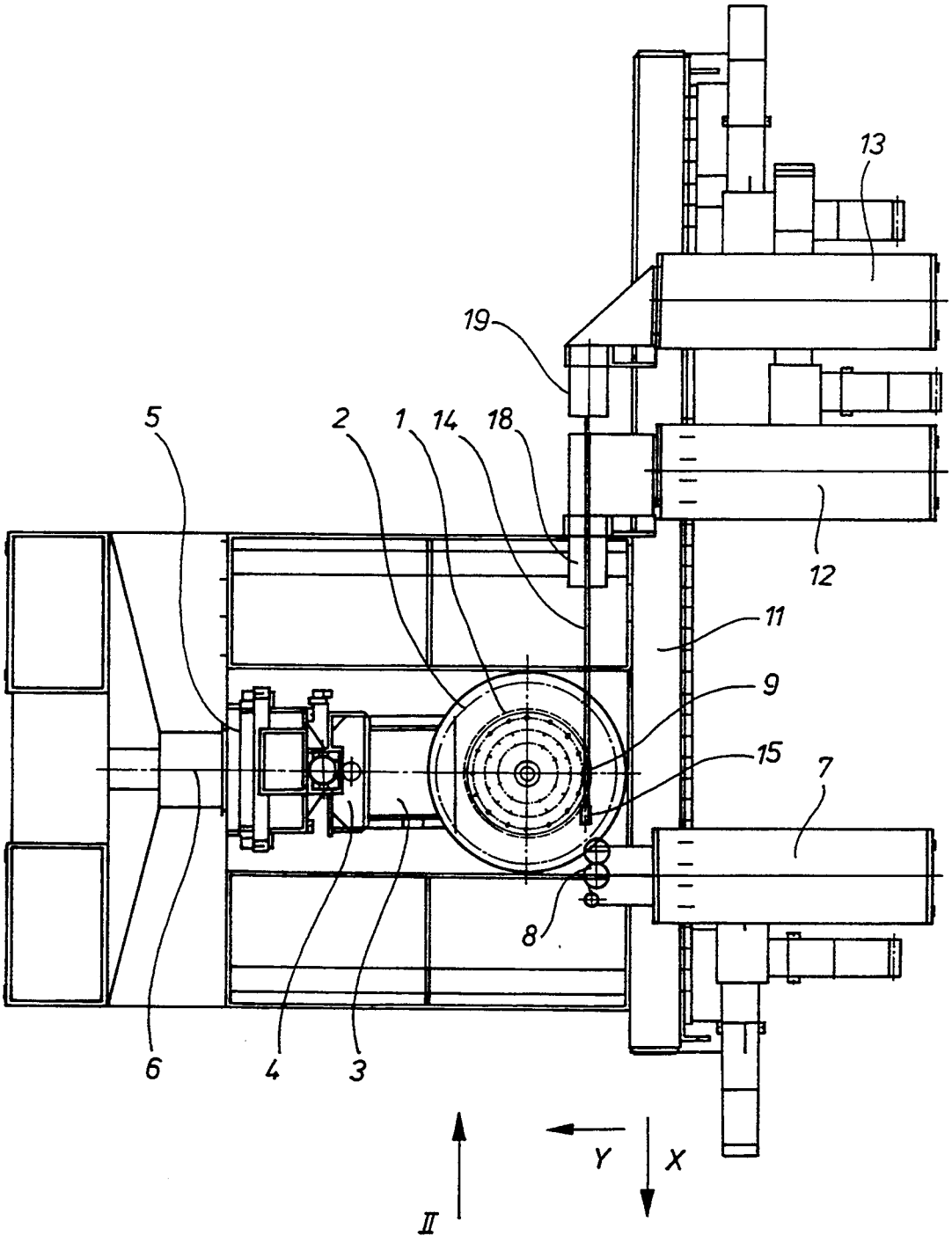

APPARATUS FOR SPATIAL UNCOILING AND STRETCH-BENDING PROCESS IN COMBINATION WITH A BENDING MANDREL STATION

The invention relates to a spatial uncoiling and stretch-bending process in combination with a mandrel bending station and the apparatus for implementation of this process, in which the section being bent is first clamped at either end and prestressed, whereupon the section is bent and in the forming area at least one section roller of the section rolling station is pressed against the section and is three-dimensionally repositioned.

The state of the art is thus a process as indicated above for spatial uncoiling and stretch-bending. It is characteristic of the known process that the initially straight metal section being bent is adjustably prestressed in the longitudinal direction and that a damping element is attached to the swing table for one-ended prestressing of the section and is held by a clamping head fastened to the damping station. The longitudinal prestressing constantly applied on the section during forming equals the shear stress generated in the section during bending and ensures a nondeforming bend. If this process is to be used to bend hollow sections or sections with undercut cavities, there is a danger of the sections collapsing during bending and thereby losing their sectional form.

The essence of the invention thus rests in the fact that the mandrel bending station, or one or several mandrels of this station, executes the same motion—if so desired, in three dimensions—as the section rollers of the section roller station. As soon as the section rollers are three dimensionally repositioned at the section to be bent, the bending mandrel is three dimensionally moved in the same fashion. The prior art is unfamiliar with such motion in the area belonging to the bending mandrel. In processes known until now, a stationary mandrel alone was used. In the invention, however, the mandrel moves, if so desired, on all spatial planes, i.e. in the X and Y directions and in the turning direction, and thus imitates the motion of the section rollers, while the section rollers are pressed from the outside onto the section being bent or onto the bending mandrel.

To be sure, filling the section cavity with the mandrel during the bending process is known to the prior art in the case of hollow sections. However, these processes as rule occur only on a single bending plane. Known alone here is the bending of such simple sections on a plane whose radius remains constant, while the mandrel bending station with the mandrel remains stationary. It is also known in this case to place the mandrel positioning station beyond the workpiece clamping station and to guide the mandrel being positioned, which fills the closed or partially open section being bent, by means of the clamping station, in order to move the mandrel into the workpiece and hold it there. Important to the prior art is the fact that the mandrel always remains at the same point, namely at the bending point, and therefore that the mandrel bending station (or the mandrel positioning station) also remains stationary, even in the bending of identical radii. After bending, the mandrel can be retracted hydraulically from the bending zone, in order to easily remove the bent workpiece.

A known stationary mandrel bending station of this type cannot be applied with the bending process described in the U.S. Pat. No. 4,941,338 or the German patent 3.618.701, however.

If such an apparatus were used for bending closed or partially open sections and a stationary mandrel positioning station were employed, the workpiece being bent would be destroyed along with the tool, since the mandrel executes a relative motion within the workpiece being bent and the desired flexion could not be applied.

The goal of the present invention, therefore, is to create a process for operating a mandrel bending station, and the mandrel bending station for performing the process, in such a way that the closed or partially open sections can be bent by means of the spatial uncoiling and stretch-bending process known to the prior art.

In solving the indicated problem, the process is characterized in that the mandrel bending station moves in agreement with the section roller station, which section roller station rests with its section rollers against the bending template facing the workpiece, and in that the form-fitting mandrel positioned in the cross-section of the workpiece being bent is mounted in turning fashion, e.g. in the mandrel bending station.

There are two different embodiments for the pivot mount of the mandrel in the mandrel bending station.

In the first embodiment the mandrel is form-fitted into the section being bent, and the mandrel positioning rod, which is connected to the mandrel by means of a pivot mount, engages on the inside of the mandrel.

In a second embodiment the mandrel is connected to the mandrel positioning rod in non-turning fashion and the mandrel positioning rod is secured in turning fashion to the mandrel bending station.

In a third embodiment the mandrel is connected to the mandrel positioning rod in non-turning fashion and the mandrel positioning rod is geared in turning fashion to the mandrel bending station and moves to the left or to the right, in congruence with the clamping head, in order to introduce torsional motion.

In the present invention it is important that the process is intended not only for the known RASB process (=spatial uncoiling and stretch-bending process), but also for an ASB process (=uncoiling and stretch-bending process), in which the section is bent on only one plane, e.g. the XY plane, while in the RASB process, bending is performed on a total of three spatial axes (X, Y, Z) with additional torsion capability available, if so desired.

This torsion capability is also available in the known ASB process. It is thus possible to subject different bending radii to bending. It is also possible instead to produce the flexion in the XY plane, not through motion of the turning axis, but through motion of the section roller station relative to the bending point.

In both processes it is significant that the mandrel bending station, according to the technical teaching of the present invention, moves in precise congruence with the section roller station, in order to hold the mandrel, which may describe motions in three dimensions (X+Y directions plus turning motion), at the bending point of the section being bent for all bending motion.

In accordance with the applicant's disclosure, e.g. in U.S. Pat. No. 4,941,338 or German patent 3.618.701, it is known that on the workpiece side of the swing table the clamping station can execute a movement in both the X and the Y directions.

This clamping station thus follows the workpiece itself as the section "winds" onto the bending template in the longitudinal direction of the workpiece, while the mandrel bending station, or the mandrel positioning rod, of the invention has an entirely different function, namely to hold the mandrel in constant motional congruence with the section roller station at the bending point of the workpiece being bent.

The positioning station thus executes the same movement in the Y direction as the roller bending station and the mandrel bending station, but only in the Y direction, whereas the clamping station executes an entirely different course of motion in the X direction.

According to the present invention, protection is also claimed for special mandrel forms, which are held in position and motionally guided by the mandrel positioning station.

In a initial, simple embodiment, the mandrel is embodied as a simple rod-like tool which is either mounting in rotating fashion as in the two embodiments described above, or is attached in non-rotating fashion to a mandrel positioning rod, which in turn is held in rotating fashion in the receiving chuck of the mandrel positioning station. In a third embodiment the mandrel the turns in gear-driven fashion.

In the past a pivot mount on the mandrel positioning rod was not needed for the mandrel, since bending was performed only on a single plane with uniform radius.

Given that three-dimensional bending occurs in the known RASB process, it is necessary under the present invention to mount the mandrel in turning fashion on the mandrel positioning station (according to the initial embodiment) or—according to the second embodiment—to connect the mandrel in non-turning fashion to the mandrel positioning rod, while mounting the mandrel positioning rod in turning fashion in a receiving chuck of the mandrel positioning station or, in a third embodiment, to turn it in geared fashion.

According to a second embodiment, for which special protection is claimed under the present invention, a further mandrel embodiment is provided.

Here the invention provides for the bending of double sections with the mandrel positioning station. Double sections of this kind are represented by two sections, one coaxially inserted into the other, which exhibit a reciprocal radial distance one from the other. In order to bend double sections of this type, an appropriately adapted mandrel is necessary, for which special protection is claimed under the present invention. Such a mandrel consists first of an inner mandrel positioning rod, which is connected to the inner mandrel in the manner described for the previously indicated embodiments. This inner mandrel serves to support the inner section of the inner coaxial section tube.

To assure the bending of the two coaxial section tubes synchronically and at a uniform distance with respect to the intermediate space between the two sections (i.e. with respect to the distance between the inner and outer sectional tube), a second mandrel shaped like the section is provided and is inserted into the intermediate space between the outer circumference of the inner section and the inner circumference of the outer section and is moved synchronically with the inner mandrel.

The outer section mandrel has a special mandrel positioning rod, which consequently is also designed as a hollow section tube and which coaxially encloses the other mandrel positioning rod.

The two mandrel positioning rods are thus clamped to the mandrel positioning station as coaxial section tubes, one inserted into the other.

The double mandrel according to the invention thus permits coaxial hollow sections to be simultaneously bent, while continuously assuring that the radial intermediate space between the inner section and the outer section remains constant, independent of the bending radius and the kind of bending performed in the three spatial planes.

It may be added that a double mandrel bending station, or double mandrel positioning station, of this kind can be employed in conventional standard apparatus, e.g. according to the ASB process, as well as in normal tube mandrel bending devices, as used in the production of exhaust pipes.

Reference is also made to the fact that the sectional form of the mandrel is adapted to the cross-section of the section being bent. I.e. any desired sectional shape for the workpieces can be bent, and a sectional form must be selected for the mandrel which is form-fitted to the inner circumference of the workpiece being bent.

With a double mandrel, for which special protection is claimed under the present invention, the sectional shape of the inner mandrel differs from the sectional shape of the outer mandrel, thereby permitting the coaxial sections to be bent; here the coaxially positioned inner section has an entirely different sectional shape than the outer section.

Here a provision can be made such that the inner circumference of the coaxially positioned inner mandrel has a different shape than the outer circumference of this section and, likewise, that the inner circumference of the coaxially positioned outer section has a different shape than the outer circumference. The inner and outer areas of the coaxially positioned mandrels are selected in keeping with these different options.

The subject matter of the present invention does not consist only of that of the individual patent claims, but also of the combination of the various patent claims among themselves. All details and features disclosed in the documentation, including the summary, and particularly the spatial designs shown in the drawings, are claimed as essential to the invention, when individually or in combination they are new vis-à-vis the state of the art.

In the following the invention will be described in greater detail on the basis of merely one approach to its embodiment. Further features and advantages essential to the invention will emerge from the drawings and their description.

Shown are:

FIG. 1 a schematic top view of an apparatus for the spatial unrolling and stretch-bending of sections of any type, showing the mandrel bending station according to the invention.

Figure 2:
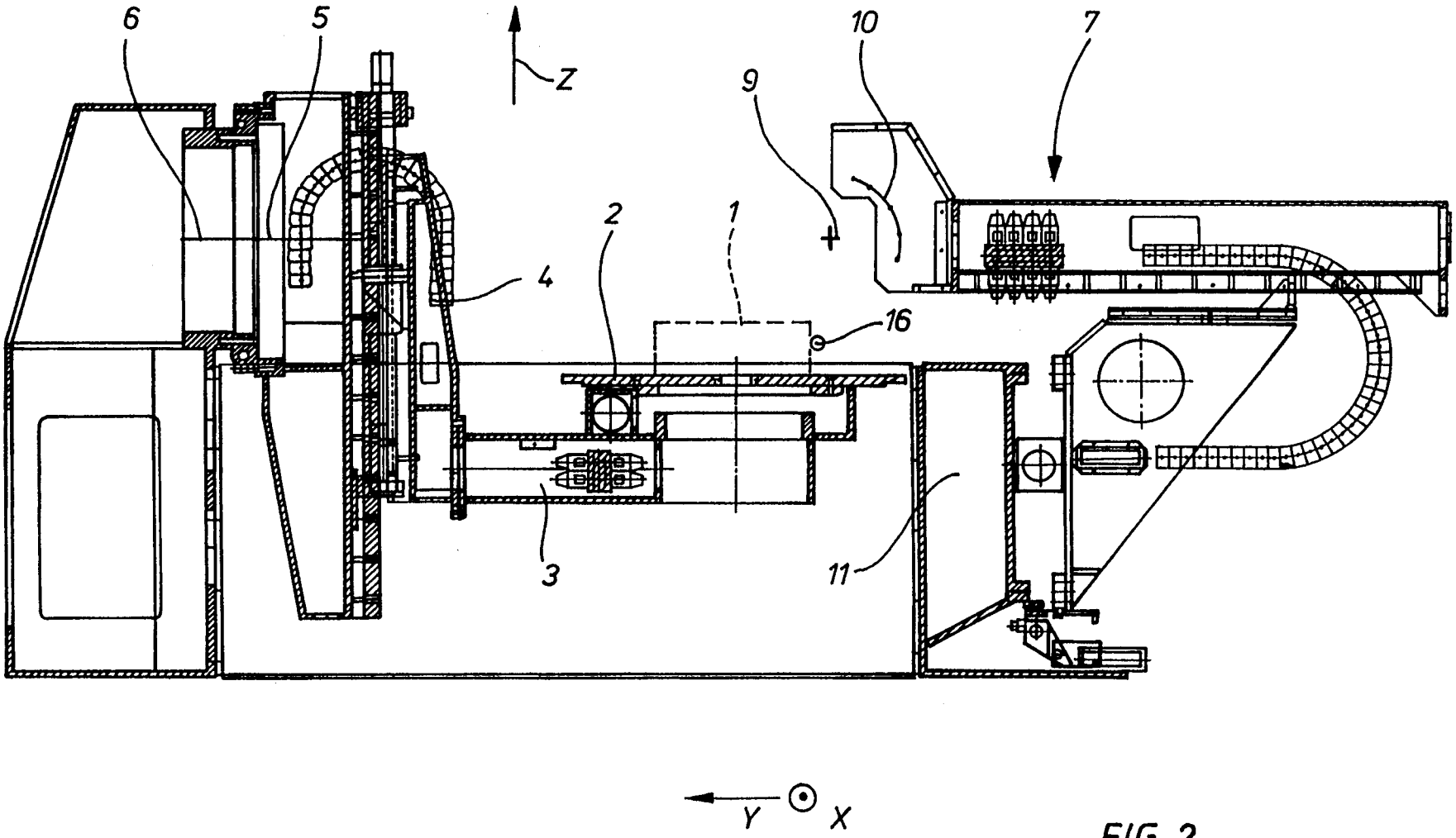

FIG. 2 a side view of the apparatus of FIG. 1 in the direction of arrow II of FIG. 1.

Figure 3:
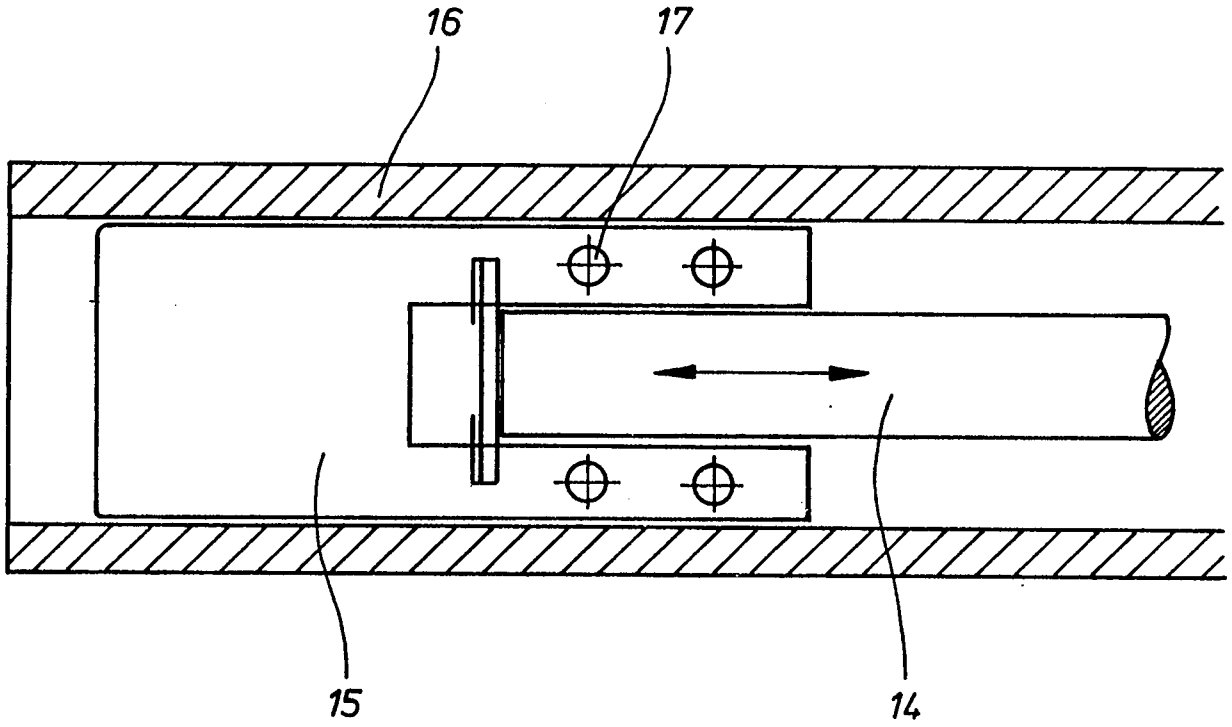

FIG. 3 a schematized section through the front part of a mandrel in inserted position within the workpiece.

Figure 4:
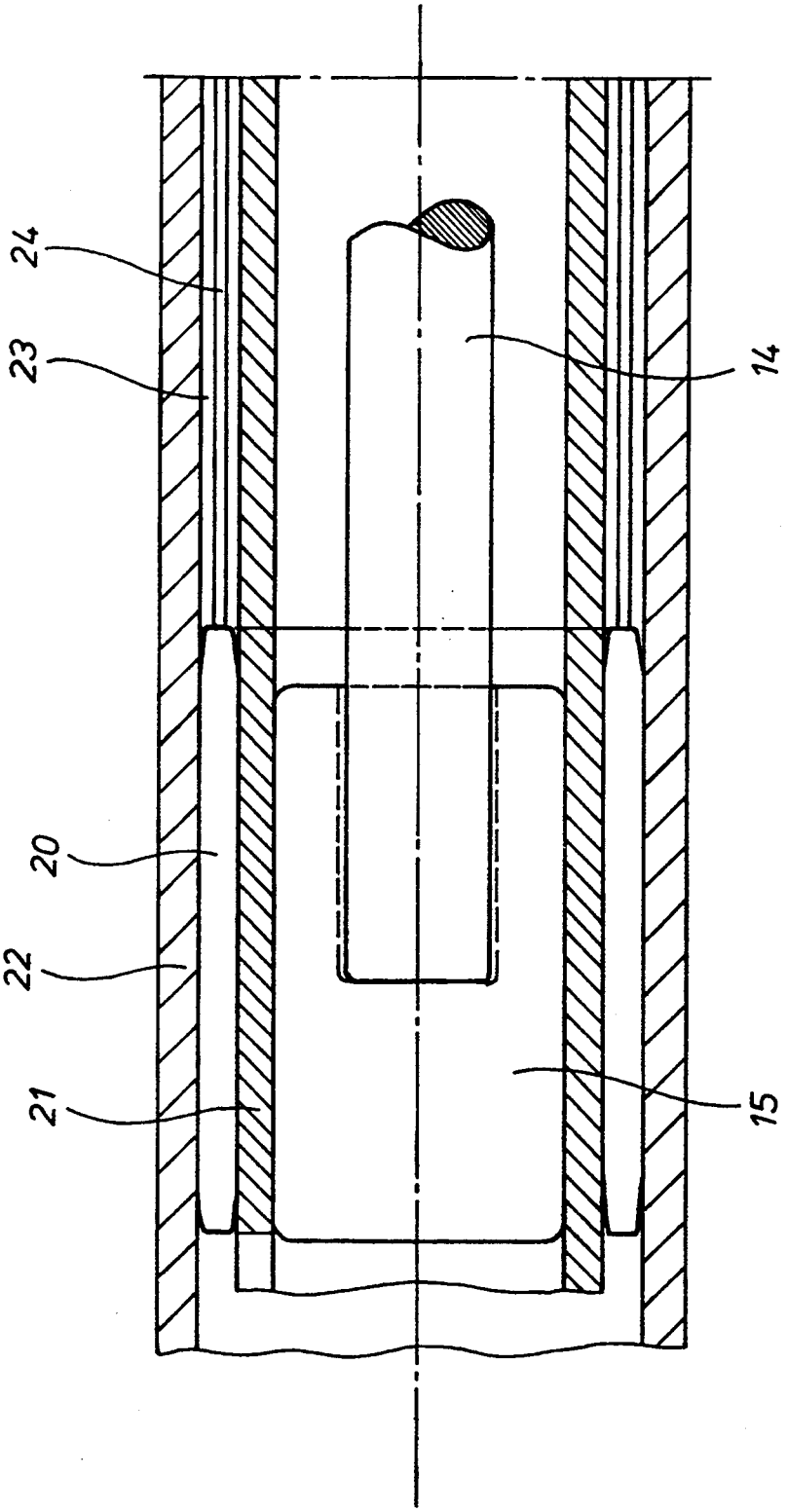

FIG. 4 same situation as in FIG. 3, with two coaxial sections, one inserted into the other.

The apparatus for the RASB process is described in greater e.g. in German patent 3 618 701 or in U.S. 4,941,338.

We herewith refer to this description, and all features of this description are encompassed by the present invention.

The apparatus basically consists of a bending tool 1, which is firmly attached to a swing table 2.

For both of these known processes, it is characteristic that the section to be bent is adjustably prestressed in its longitudinal direction while the prestressed section is subjected to rotary bending.

When prestressing the section to be bent, this section first is damped in a damping on one end and damped in a damping on the swing table 2 on the other end. The swing table 2 is then driven rotationally for a short distance in the direction which exerts prestressing on the section which is maintained during the entire forming process.

The workpiece 16 to be bent is form-fitted against the outer circumference of the bending tool 1.

The swing table 2 is driven in rotating fashion and in addition is fitted into a swing table bracket 3, which is attached to a carriage 4 which moves in the Z direction.

The carriage guide of the Z carriage 4 is secured in turn on the swivel bearing 5, which is driven in rotating fashion around the axis 6.

It is thus possible to move the swing table 2 in the Z direction and additionally to swing it around the axis 6 as if it were a Y axis.

Bending of the workpiece occurs here at the bending point 9, where a section roller bending station 7—extended in FIG. 1 for clarity of representation—exhibits section rollers 8 on its front side, and these section rollers 8 rest at the bending point in a form-fitting manner against the workpiece being bent.

In the depiction according to FIG. 1, the section roller bending station 7 is displaced downward in direction X of the arrow, in order to the make the bending point visible.

In addition, FIG. 1 does not show the workpiece itself, but rather the mandrel complex to be introduced into the workpiece. The mandrel complex consists here of a mandrel 15, which is positioned on the front side of a mandrel positioning rod 15.

The mandrel positioning rod 14 passes through and engages with a clamping head 18 of the clamping station 12 and is received in the securing head 19 of a mandrel bending station 13.

The workpiece 16 being bent is clamped securely both to the bending tool 1 on the swing table 2 and, at its other end, to the clamping head 18 of the clamping station 12.

Bending on the three spatial axes X, Y, Z occurs in that the swing table is set in turning motion and at the same time the carriage 4, and if need be the swivel beating 5 are turned in the Z direction; in the process, it is important that the section roller bending station 7 executes the corresponding movements over the three spatial axes to permit bending of the workpiece 16 in the desired directions.

FIG. 2 shows only the curved track 10 of the section roller bending station; the curved track 10 receives the mountings for the section rollers 8. Furthermore, the bending point 9 is depicted in schematized form; it can be seen that the section rollers 8 are positioned in the section roller bending station 7 in such a way that they always follow the bending point 9 as it moves through the three spatial planes.

It is important to note that because of the winding motion of the bending tool 1 on the swing table 2, the clamping station 12 moves progressively to the left, in the direction X of the arrow, on the joint track bed 11 for the section roller bending station, the clamping station 12, and the mandrel bending station 13, while the mandrel bending station 13 synchronically follows all movements of the section roller bending station 7 over all three spatial axes X, Y, Z.

This measure assures that the mandrel 15, which is located inside of the section to be bent and which fills the section in a form-fitting manner, precisely follows all movements of the bending point 9.

FIG. 3 shows an initial embodiment of the mandrel 15 in its mount on a mandrel positioning rod 14. It will be seen that the mandrel 15 rests in a form-fitting manner in the inner section of the workpiece and is connected with the mandrel positioning rod 14 in turning fashion by means of a pivot mount 17, the mandrel positioning rod 14 itself being held in non-turning fashion in the securing head 19 of the mandrel bending station 13.

In a second embodiment, not shown in the drawing, the mandrel 15 is connected in non-turning fashion to the mandrel positioning rod 14, e.g. by means of a thread and the mandrel positioning rod 14 is then attached in turning fashion to the securing head 19 by means of a pivot mount.

FIG. 4 shows a double configuration as employed according to the invention for bending coaxial tubes in the X, Y, and Z direction.

Here an inner section 21 is positioned within the inner circumference of an outer section 22, the two sections thus forming an intermediate space 23 between the two of them.

The invention provides for a double configuration in order to bend this kind of coaxial combination of sections.

The double configuration consists of an hollow outer mandrel 20, which is inserted into the intermediate space 23 between the inner circumference of the outer section 22 and the outer circumference of the inner section 21.

The hollow mandrel 20 is connected to a hollow mandrel positioning rod 24 by means of the two mounting procedures described above, the hollow mandrel positioning rod 24 being held in the securing head 19 of the mandrel bending station 13.

At the same time, the inner circumference of the inner section 21 is form-fitted against the outer circumference of the mandrel 15, which itself is connected to the mandrel positioning rod 14 by means of the two mounting procedures described above.

The mandrel positioning rod 14 is coaxially guided through the inside of the hollow mandrel rod 24 and is also held in the securing head 19 of the mandrel bending station 13.

The described double configuration and the known RASB apparatus thus allow coaxial sections of any shape to be bent in all three spatial directions.

Important to all the described processes (simple mandrel configuration and double mandrel configuration) is the fact that the bending point 9 remains stationary on the Z plane, since the workpiece 16 itself moves on the swing table in the Z direction. The bending point 9 thus wanders only in the X or Y direction, depending on the profile provided for the workpiece being bent. Consequently the section roller station must also move only in the X or Y direction; likewise the clamping station 12 and the mandrel bending station 13.

Whereas the clamping station 12 executes an additional advancing motion in the X direction (due to the winding motion of the workpiece 16 on the bending tool 1), this additional movement in the X direction is not required of the section roller bending station 7 and of the mandrel bending station 13. These two stations 7 and 13 move here for a different reason, namely so that the bending point 9 always remains in the indicated position at the bending tool 1 in the Z plane A double section tube configuration of the given type is thus held by the clamping head 18, also coaxial in design, at the clamping station 12; after bending is complete and after the application, if necessary, of several successive flexions, a double section of the desired spatial form can be bent, it being assured that the two sections always exhibit a constant intermediate space 23, even at the bending point.

To apply successive flexions, care must be taken to assure that the double configuration is always positioned at the bending point 9.

Important to the present invention is the fact that sections of the desired form can be bent over the three spatial axes, while—when a coaxial design is involved—the sections can have differing outer and inner profiles, and that despite this fact, complicated profile designs can be subjected to bending when mandrels of corresponding profile are employed. For example, it is possible to bend ribbed profiles, where, e.g., a tube which is internally ribbed is coaxially contained in a smooth outer tube.

Numerical References of Drawing

1 bending tool
2 swing table
3 swing table bracket
4 Z carriage
5 swivel bearing
6 axis
7 section roller bending station
8 section rollers
9 bending point
10 curved track
11 track bed
12 clamping station
14 mandrel positioning rod
15 mandrel
16 workpiece
17 bearing
18 clamping head
19 securing head
20 hollow mandrel
21 inner section
22 outer section
23 intermediate space
24 hollow mandrel positioning rod

I claim:

1. An apparatus for a spatial uncoiling and stretch-bending process, in combination with at least one mandrel of a mandrel bending station, comprising:

a clamping device for a section being bent;

a bending tool against which the section being bent is fitted;

means for movably mounting said bending tool;

at least one section roller pressing against the section being bent; and a section roller bending station including means for repositioning said at least one section roller corresponding to movement of said bending tool;

wherein (a) the mandrel bending station moves the at least one mandrel so that it follows all movements of the at least one section roller as said at least one section roller is repositioned along three spatial axes and (b) the at least one mandrel is mounted rotatably.

2. The apparatus of claim 1, wherein the mandrel (15) is connected to a mandrel positioning rod (14) in non-turning fashion and the mandrel positioning rod (14) is secured to the mandrel bending station (13) in turning fashion in a securing head (19).

3. The apparatus of claim 1, wherein the mandrel (15) comprises a rod-like tool.

4. The apparatus of claim 1, wherein the mandrel comprises an inner mandrel positioning rod with an inner mandrel and a second mandrel having a different shape than the inner mandrel inserted in an intermediate space between the outer circumference of the inner section and the inner circumference of the outer section, the outer section mandrel comprising a mandrel positioning rod having a hollow section.

5. The apparatus of claim 1, wherein the mandrel is connected to the mandrel positioning rod in non-turning relationship and the mandrel positioning rod is attached to the mandrel bending station in geared, turning relationship and moves in opposite directions in agreement with the clamping head to introduce a torsional motion.

6. An apparatus for a spatial uncoiling and stretch-bending process, in combination with at least one mandrel of a mandrel bending station, comprising:

a clamping device for a section being bent;

a bending tool against which the section being bent is fitted;

means for movably mounting said bending tool;

at least one section roller pressing against the section being bent;

a section roller bending station including means for repositioning said at least one section roller corresponding to movement of said bending tool; and a mandrel positioning rod, connected to the at least one mandrel by a pivot bearing, engaging inside the at least one mandrel;

wherein (a) the mandrel bending station moves the at least one mandrel so that it follows all movements of the at least one section roller as said at least one section roller is repositioned along three spatial axes, (b) the at least one mandrel is mounted for turning, and (c) the mandrel is form-fitted into the section being bent.

* * * * *